US007568894B2

(12) United States Patent
Uratani

(10) Patent No.: US 7,568,894 B2
(45) Date of Patent: Aug. 4, 2009

(54) HERMETIC COMPRESSOR

(75) Inventor: Akio Uratani, Yasu (JP)

(73) Assignee: Panasonic Corporation, Osaka (JP)

( * ) Notice: Subject to any disclaimer, the term of this patent is extended or adjusted under 35 U.S.C. 154(b) by 768 days.

(21) Appl. No.: 11/180,209

(22) Filed: Jul. 13, 2005

(65) Prior Publication Data

US 2006/0013697 A1 Jan. 19, 2006

(30) Foreign Application Priority Data

Jul. 14, 2004 (JP) ..... 2004-207141

(51) Int. Cl.

| | |
|---|---|
| ***F04B 49/00*** | (2006.01) |
| ***G01N 33/26*** | (2006.01) |
| ***G01M 19/00*** | (2006.01) |
| ***G01F 23/00*** | (2006.01) |

(52) U.S. Cl. ..... 417/63; 417/902; 73/53.05; 73/168; 73/295

(58) Field of Classification Search ..... 417/63, 417/902; 184/6.18, 108; 73/53.05, 61.76, 73/168, 295

See application file for complete search history.

(56) References Cited

U.S. PATENT DOCUMENTS

| | | | | |
|---|---|---|---|---|
| 4,135,186 | A * | 1/1979 | Minorikawa et al. | 340/622 |
| 5,929,754 | A * | 7/1999 | Park et al. | 340/439 |
| 6,276,901 | B1 * | 8/2001 | Farr et al. | 417/13 |
| 2003/0046997 | A1 * | 3/2003 | Waller | 73/295 |
| 2003/0221485 | A1 * | 12/2003 | Toki | 73/295 |

FOREIGN PATENT DOCUMENTS

| | | |
|---|---|---|
| JP | 6-159274 | 6/1994 |
| JP | 2001-12351 | 1/2001 |

* cited by examiner

*Primary Examiner*—Charles G Freay
(74) *Attorney, Agent, or Firm*—RatnerPrestia

(57) ABSTRACT

A hermetic compressor includes a housing which accommodates a motor and a compressing mechanism, an oil surface sensor mounted to a side wall of the housing, and refrigerating machine oil. The oil surface sensor is integrally formed of a detector for detecting a position of the oil surface of the refrigerating machine oil and a hermetic terminal. The hermetic terminal is placed at an end of a cylindrical tube having a smaller diameter than that of the housing, and the detector of the oil surface sensor is disposed inside the cylindrical tube.

7 Claims, 5 Drawing Sheets

HERMETIC COMPRESSOR

FIELD OF THE INVENTION

The present invention relates to hermetic compressors to be mounted in air-conditioners or refrigerators and used for compressing refrigerant.

BACKGROUND OF THE INVENTION

A conventional hermetic compressor (hereinafter referred to simply as "compressor"), which is formed of a compressing mechanism and an electric motor both accommodated in a housing hermetically welded, is disclosed in Japanese Patent Unexamined Publication No. H06-159274. This compressor is free from refrigerant leakage or water invasion, so that it has been widely used in air-conditioners or refrigerators because of its high reliability.

FIG. 7 shows a sectional view of a conventional compressor. In FIG. 7, compressing mechanism 303, electric motor 304 and refrigerating machine oil are accommodated in cylindrical housing 302 to form the compressor. Housing 302 is provided with discharging tube 306 at its upper end for discharging compressed gas refrigerant.

Compressing mechanism 303 is rigidly mounted to housing 302, and is coupled to sucking tube 305 which feeds the gas refrigerant thereto. Compressing mechanism 303 is coupled to motor 304 with driving shaft 307, so that motor 304 drives compressing mechanism 303.

Motor 304 is placed above compressing mechanism 303 and connected to hermetic terminal 308 welded to the upper end of housing 302. Terminal 308 is excellent in pressure resistance and airtight performance, and motor 304 is powered by an external source via terminal 308.

The foregoing compressor supplies the refrigerating machine oil pooled in housing 302 to compressing mechanism 303 and its bearings for lubrication. The refrigerating machine oil pooled in housing 302 is discharged together with compressed gas refrigerant from the compressor. Under normal conditions, the oil circulates through a refrigerant circuit and returns to the compressor, so that the amount of the oil is maintained in housing 302. However, the amount of the oil varies depending on the operation, and it sometimes becomes short and fails in lubrication.

The problem discussed above has been addressed by some proposals, for instance, Japanese Patent Unexamined Publication No. 2001-12351 discloses the following idea: Oil surface position 309 of the refrigerating machine oil in housing 302 is sensed by a sensor, so that a shortage of the oil is detected for protecting the compressor. In other words, a detection of a lower surface position 309 of the oil carries out a protecting action, such as stopping the compressor, or collecting the oil from the refrigerant circuit, thereby avoiding damage to the compressor.

Detection of oil surface 309 in housing 302 needs housing 302 to be equipped with sensors, and transmitting signals of the sensors to the outside of housing 302. For this purpose, a conventional compressor mounts sensors rigidly in housing 302, and provides housing 302 with terminals for transmitting the signals to the outside. However, this structure complicates the compressor, and the add-on terminals will invite a defect in the airtight performance. This structure also needs connecting the sensors to the terminals in housing 302, so that a possible disconnection will lower the reliability.

The foregoing publication (No. 2001-12351) also discloses that an oil surface sensor, which is integrally formed of a detector for detecting an oil surface in the housing and hermetic terminals, is mounted on a side-wall of the housing. However, since the side-wall shapes like a cylinder, the mounting of the sensor onto the side-wall will invite a defect in airtight performance due to distortion, or causes a failure in airtight performance due to a collision in assembling the compressor.

The detector is placed inward of the inside wall of the housing, so that the detector sometimes erroneously detects the oil surface. Because parts of the refrigerating machine oil touch the detector of the oil surface sensor when the oil discharged together with the gas refrigerant during the operation returns from a position higher than the oil surface to the lower section of housing 302, or when the oil after the lubrication through the compressor is discharged from the upper section and returns from a position higher than the oil surface to the lower section of housing 302.

Further, the oil surface sensor is mounted in the housing at a place corresponding to the lower limit of the oil surface, and after a detection of the lower limit of the oil surface, the oil surface cannot rebound immediately although an oil-surface rebounding action is taken. This delay further lowers the oil surface. This phenomenon sometimes causes serious damage to the compressor.

SUMMARY OF THE INVENTION

A hermetic compressor of the present invention comprises the following elements:

- an electric motor;
- a compressing mechanism driven by the motor;
- a housing accommodating the motor and the compressing mechanism;
- refrigerating machine oil pooled in the housing; and
- an oil surface sensor mounted on a side wall of the housing.

The oil surface sensor includes a detector for detecting an oil surface of the refrigerating machine oil, a hermetic terminal integrally formed with the detector. The hermetic terminal is placed at a first end of a first cylindrical tube having a diameter smaller than that of the housing, and the detector is placed inside of the first cylindrical tube.

The foregoing structure allows the compressor to be in a simple construction, and to detect positively the oil surface in the housing, so that reliability of refrigerators employing this compressor can be improved.

DETAILED DESCRIPTION OF PREFERRED EMBODIMENT

Exemplary embodiments of the present invention are demonstrated hereinafter with reference to the accompanying drawings.

Exemplary Embodiment 1

Figure 1:
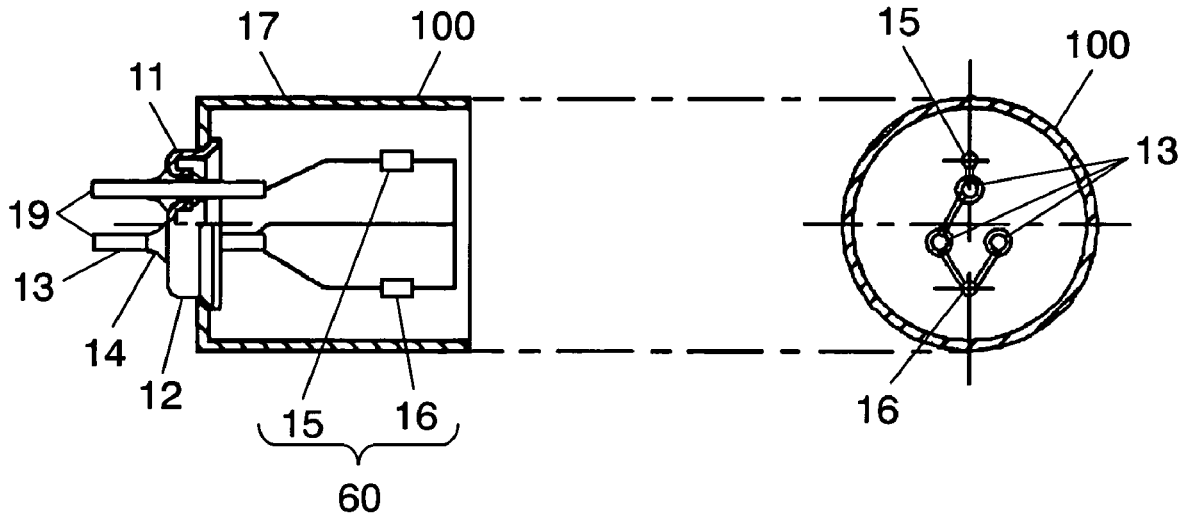
FIG. 1 shows an oil surface sensor placed in a compressor in accordance with a first exemplary embodiment of the present invention.
Figure 2:
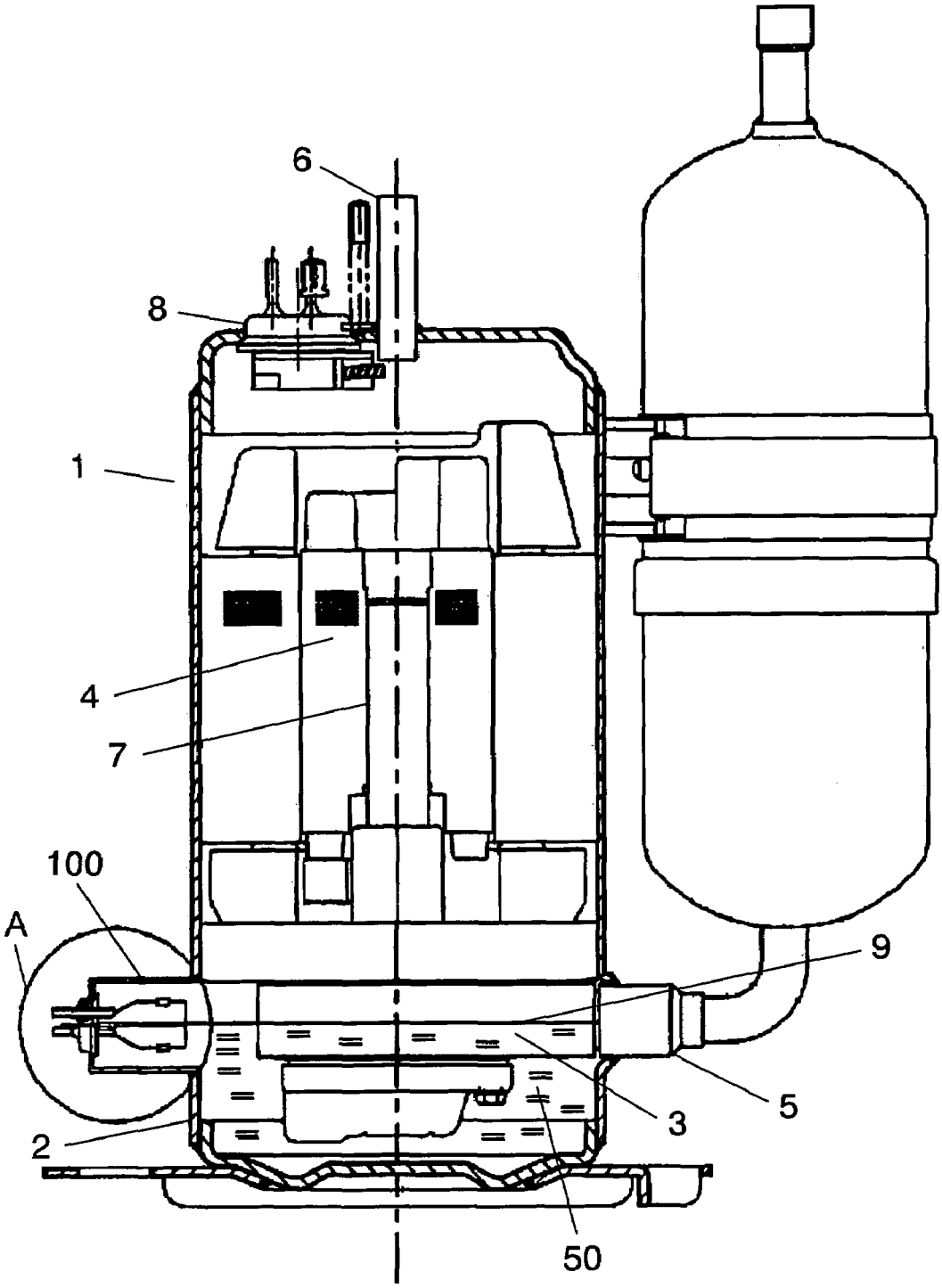
FIG. 2 shows a schematic diagram illustrating a compressor in accordance with the first exemplary embodiment of the present invention.
Figure 3:
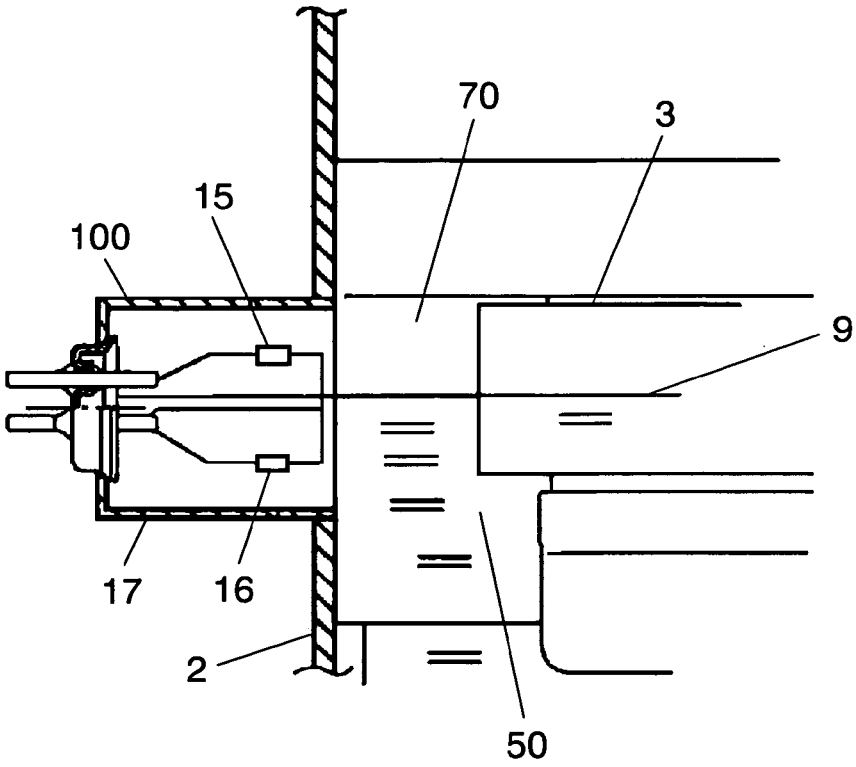
FIG. 3 shows an enlarged view of section A shown in FIG. 2.

FIG. 1 shows an oil surface sensor placed in a compressor in accordance with the first exemplary embodiment of the present invention. FIG. 2 shows a schematic diagram illustrating the compressor in accordance with the first exemplary embodiment, and FIG. 3 shows an enlarged view of section A shown in FIG. 2.

FIG. 1 shows a structure of oil surface sensor 100 to be mounted at the compressor in accordance with the first embodiment, and FIG. 2 illustrates compressor 1 equipped with oil surface sensor 100 shown in FIG. 1 at its side wall.

In FIG. 2, compressor 1 is formed of compressing mechanism 3 and motor 4 both accommodated in cylindrical housing 2. In other words, compressor 1 shapes like a high pressure dome. Housing 2 is equipped with discharge tube 6 at its upper end for discharging compressed gas refrigerant.

Compressing mechanism 3 is a rolling piston model and rigidly mounted to housing 2, and connected with sucking tube 5 for feeding gas refrigerant into housing 2. Compressing mechanism 3 is coupled to motor 4 with driving shaft 7, so that it is driven by motor 4.

Motor 4 is disposed above compressing mechanism 3 and connected to hermetic terminal 8 welded at the upper end of housing 2. Terminal 8 is used for powering, and an external source powers motor 4 through this hermetic terminal 8.

Driving shaft 7 is equipped with a centrifugal pump (not shown) and a lubrication path (not shown), and disposed extending through compressing mechanism 3. The centrifugal pump is disposed at a lower end of driving shaft 7, so that it can pump up refrigerating machine oil 50 pooled at the bottom of housing 2. The lubrication path is formed inside shaft 7 along the axial direction, and supplies oil 50 pumped up by the centrifugal pump to the respective sliding sections.

As shown in FIG. 2, oil surface sensor 100 is mounted on the side wall of housing 2 by welding or brazing at the lower section such that it corresponds to a position of oil surface 9 in housing 2.

Oil surface sensor 100 is detailed hereinafter with reference to FIG. 1. Sensor 100 is integrally formed of hermetic terminal 11 together with detector 60 for detecting a position of oil surface 9 of oil 50 shown in FIG. 2. Detector 60 is equipped with a thermistor as first detector 15 and another thermistor as second detector 16. In sensor 100, hermetic terminal 11 is welded to a first end of first cylindrical tube 17 having a smaller diameter than that of housing 2 and retrofitted to housing 2. A second end of tube 17 is left open. Detector 60 is placed inside the first tube 17. Oil surface sensor 100 discussed above is mounted at a given plate of the side wall of housing 2 as shown in FIG. 2, so that first detector 15 and second detector 16 are placed corresponding to oil surface positions in housing 2.

Hermetic terminal 11 is formed of disc-shaped base 12 and three electrode-pins 13 extending through base 12. Each one of pins 13 is fixed to base 12 via insulator 14 made of glass, so that pins 13 are isolated from base 12.

Detector 60 placed in first tube 17 is coupled to each one of pins 13. In other words, in the condition of sensor 100 being mounted to housing 2, as the front view of FIG. 1 shows, first detector 15 placed above detector 16 is coupled to between the first and second electrode pins among pins 13, and second detector 16 is coupled to between the second and third electrodes pins among pins 13. Respective pins 13 are coupled to signal leads 19 which are coupled to a controller (not shown). The signals detected by first and second sensors 15 and 16 are respectively transmitted to the controller via signal leads 19.

An oil surface detection of compressor 1 is demonstrated with reference to FIGS. 2 and 3. Compressor 1 discharges not only refrigerant to be discharged but also refrigerating machine oil 50, so that a position of oil surface 9 changes during the operation. In order to solve this problem, compressor 1 in accordance with the first embodiment detects a position of the oil surface in housing 2 with oil surface sensor 100. In the case of using the high-pressure dome model, while refrigerating machine oil 50 stands at around 60° C. during the operation, gas refrigerant 70 stands at around 80° C., however, both of them change depending on an operating condition. Oil surface sensor 100 thus detects the position of oil surface 9 based on the difference in temperatures between oil 50 and gas refrigerant 70.

To be more specific, as shown in FIG. 3, when oil surface 9 stands between first detector 15 and second detector 16, first detector 15 detects a temperature of gas refrigerant 70 while second detector 16 detects a temperature of refrigerating machine oil 50. Since the difference between the temperatures detected by first detector 15 and second detector 16 corresponds to the difference between the temperatures of oil 50 and gas refrigerant 70, it can be determined that oil surface 9 stands between first detector 15 and second detector 16. On the other hand, when both the temperatures detected by first and second detectors 15, 16 correspond to the temperature of oil 50, it can be determined that oil surface 9 stands above first detector 15. When both the temperatures detected by first and second detectors 15, 16 correspond to the temperature of gas refrigerant 70, it can be determined that oil surface 9 stands below second detector 16.

Oil surface sensor 100 is situated at the place corresponding to the limit of oil surface 9 in housing 2. If sensor 100 determines that oil surface 9 is under second detector 16, some measures is needed to raise oil surface 9. To be more specific, an oil separator or an oil reservoir tank is placed in a discharging line of a refrigerating cycle, and the valve thereof is controlled for feeding refrigerating machine oil 50 from the sucking side into compressor 1 in which oil surface 9 is lowered.

When plural compressors are placed in one refrigerating cycle and they are operated simultaneously or independently, each one of the compressors is equipped with oil surface sensor 100 for detecting an oil surface to be controlled. This is a mechanism similar to the case where a refrigerating cycle has one compressor equipped with one surface sensor 100.

Oil surface sensor 100 has detector 60 at such a certain place as detector 60 is not placed inward of the side wall of compressor 1 and detector 60 is placed inside first cylindrical tube 17. This structure allows the machine oil from various routes not to touch the surfaces of first and second detectors 15, 16. As a result, an erroneous detection of the oil surface can be prevented. Meanwhile, the machine oil from various routes includes the oil discharged together with gas refrigerant during the operation of the compressing mechanism, the oil discharged after lubricating the compressing mechanism from the upper section of the compressing mechanism. When those oils return from a place higher than the oil surface to a lower section of housing 2, some oil returns along compressing mechanism 3, some oil returns along the inside wall of housing 2, and some oil is splashed by the rotor of motor 4 to the rim of housing 2.

As discussed above, the first embodiment proposes to provide compressing mechanism 1 with oil surface sensor 100. This structure allows a positive detection of a lower oil surface 9 in compressor 1, so that troubles caused by failure of lubrication such as seizing can be prevented. As a result, compressor 1 improves its reliability, which eventually improves the reliability of a refrigerating device employing compressor 1.

The first embodiment also proposes that hermetic terminal 11 be equipped with first detector 15 and second detector 16, and terminal 11 is mounted at the first end of first cylindrical tube 17 having a diameter smaller than that of housing 2 and retrofitted to housing 2. A second end of tube 17 is left open. Oil surface sensor 100 is mounted on the side wall of housing 2 such that detector 60 is located inside tube 17. Therefore, nothing but mounting oil surface sensor 100 to housing 2 allows detecting an oil surface position in housing 2, and transmitting the detection signal to the outside of housing 2. As a result, the construction of compressor 1 can be simplified comparing with a conventional one in which a sensor and a terminal for transmitting a signal are independently provided.

Hermetic terminal 11 is not directly mounted onto the surface of cylindrical housing 2, so that housing 2 is free from a failure in airtight performance or pressure resistance due to distortion by welding, and oil surface sensor 100 can be positively mounted to housing 2. On top of that, fewer damages due to collision can be expected in the assembly line.

The oil discharged together with gas refrigerant during the operation of compressing mechanism 3 and the oil discharged after the lubrication through compressing mechanism 3 from the upper section thereof return from a place higher than the oil surface position to the lower section of housing 2. At that time, parts of those oils do not touch detector 60 of sensor 100, so that detector 60 can correctly detect both the temperatures of gas refrigerant 70 and refrigerating machine oil 50. As a result, no erroneous detection can be expected.

Hermetic terminal 11, i.e. an element of sensor 100, has been conventionally used for feeding motor 4 in housing 2 with power, so that it has been well acclaimed excellent in airtight performance and pressure resistance. Use of such highly acclaimed hermetic terminal 11 allows mounting oil-surface sensor 100 positively to housing 2 without failing in airtight performance or pressure resistance.

In this embodiment, hermetic terminal 11 having three electrode-pins 13 is used for constructing oil surface sensor 100; however, a hermetic terminal having four electrode-pins can be used instead. In this case, two pins among four pins are connected to first detector 15 placed above second one, and other two pins are connected to second detector 16. There is another case; hermetic terminal 11 having two electrode-pins 13 can be used. In this case, one detector is used for constructing the oil surface sensor, then the sensor can detect whether the oil surface is located above or under the detector.

Exemplary Embodiment 2

Figure 4:
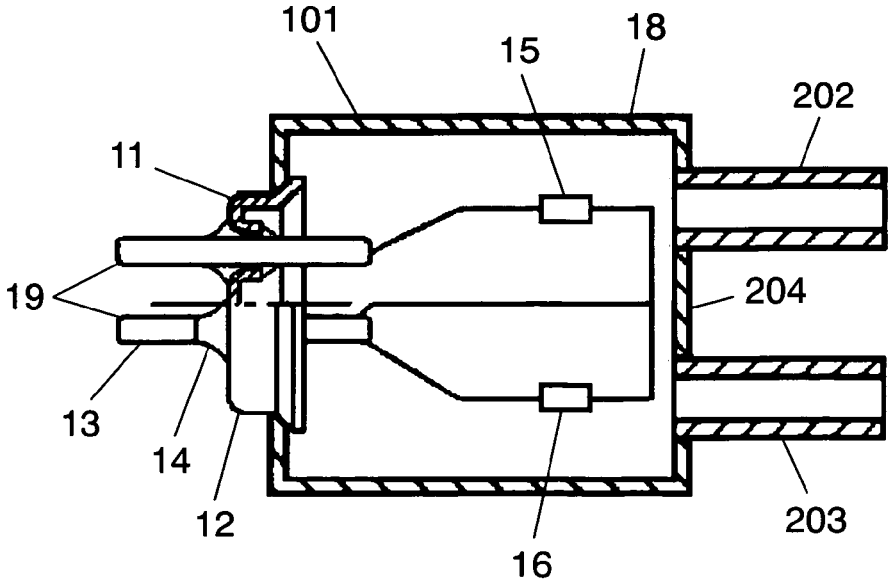
FIG. 4 shows an oil surface sensor placed in a compressor in accordance with a second exemplary embodiment of the present invention.
Figure 5:
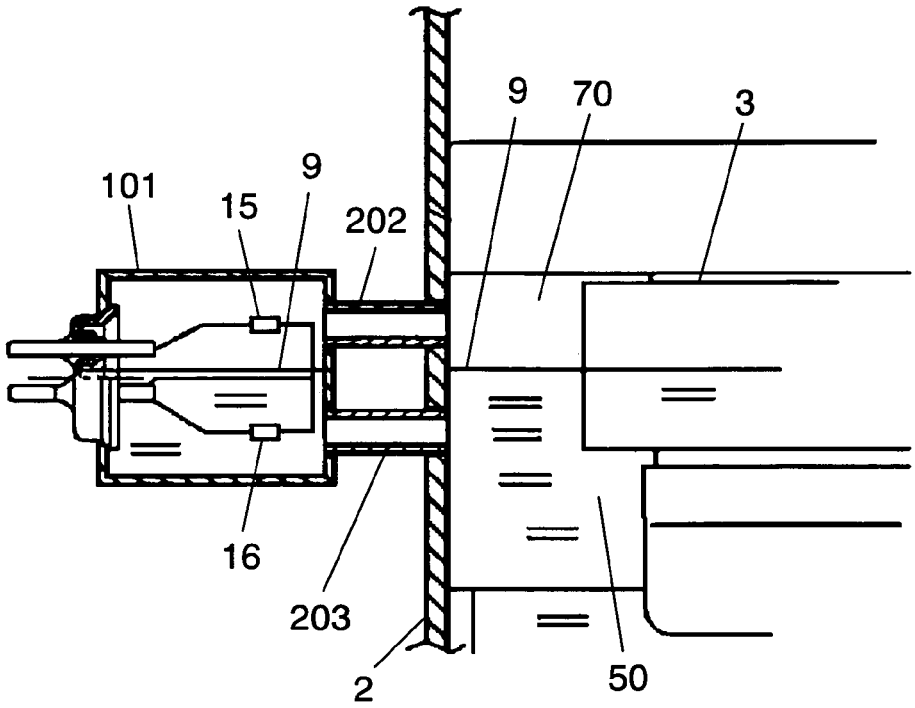
FIG. 5 shows an enlarged sectional view illustrating the oil surface detector of the compressor in accordance with the second exemplary embodiment of the present invention.
Figure 6:
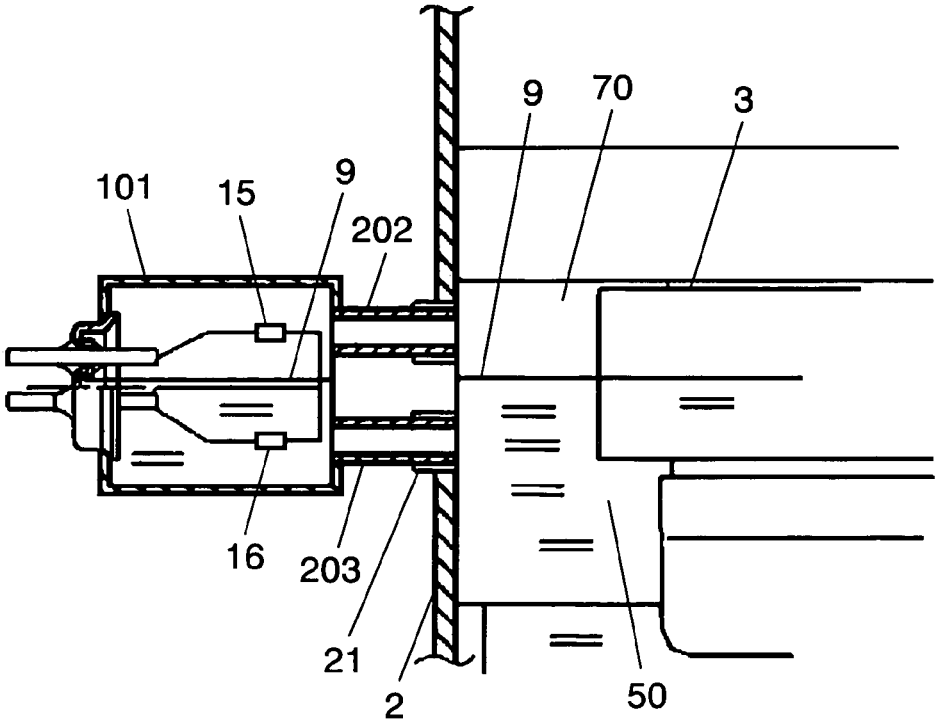
FIG. 6 shows an enlarged sectional view illustrating a modified example of the oil surface detector of the compressor in accordance with the second exemplary embodiment of the present invention.
Figure 7:
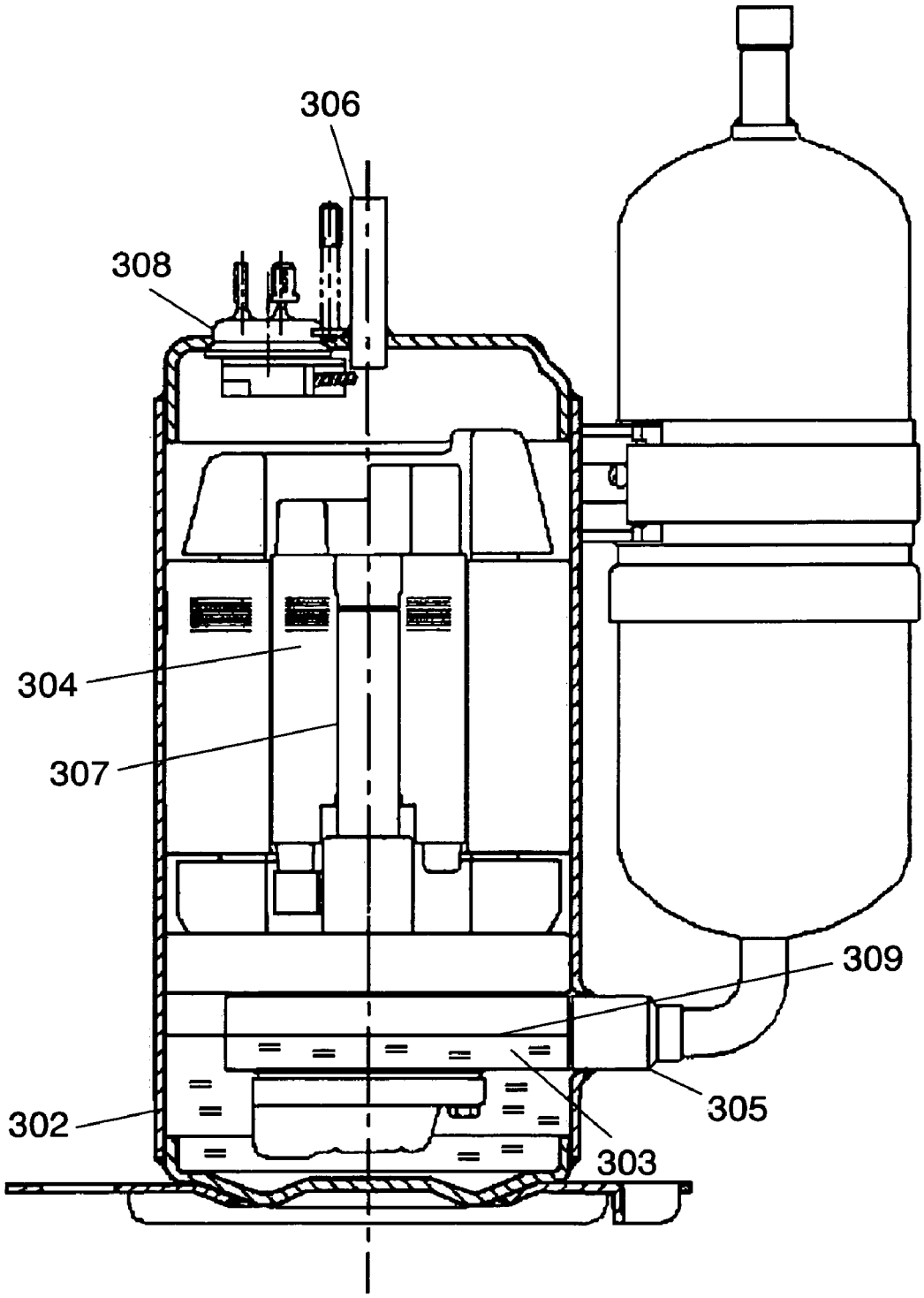
FIG. 7 shows a sectional view illustrating a conventional compressor.

FIG. 4 shows an oil surface sensor placed in a compressor in accordance with the second exemplary embodiment of the present invention. FIG. 5 shows an enlarged sectional view illustrating the oil surface detector of the compressor in accordance with the second exemplary embodiment. FIG. 6 shows an enlarged sectional view illustrating a modified example of the oil surface detector of the compressor in accordance with the second exemplary embodiment.

This second embodiment proposes the compressor similar to that demonstrated in the first embodiment. Structures different from those in the first embodiment are mainly described hereinafter. As shown in FIG. 4, first detector 15 and second detector 16 both for detecting a position of oil surface 9 in housing 2, and hermetic terminal 11 are integrally formed. Terminal 11 is disposed at a first end of first cylindrical tube 18 retrofitted to housing 2 and having a smaller diameter than that of housing 2 shown in FIG. 1. The second embodiment proposes that oil surface sensor 101 have lid 204 at a second end of tube 18, and second cylindrical tube 202 and third cylindrical tube 203 are mounted to lid 204. Both of tubes 202 and 203 have smaller diameters than that of tube 18.

Similar to the first embodiment shown in FIG. 1, hermetic terminal 11 is equipped with disc-shaped base 12 and three electrode-pins 13 extending through base 12. Each one of pins 13 is fixed to base 12 via insulator 14 made of glass, so that pins 13 are isolated from base 12.

Respective three pins 13 are coupled to first detector 15 and second detector 16 placed in first tube 18. In other words, in the condition of sensor 101 being mounted to housing 2, as the front view of FIG. 4 shows, first detector 15 placed above detector 16 is coupled to between the first and second electrode pins among pins 13, and second detector 16 is coupled to between the second and third electrodes pins among pins 13. Respective pins 13 are coupled to signal leads 19 which are coupled to a controller (not shown). The signals detected by first and second sensors 15 and 16 are respectively transmitted to the controller via signal leads 19.

Oil surface sensor 101 is mounted on the side wall of housing 2 by brazing, or as shown in FIG. 6, tubes 21 made of copper are brazed to housing 2 in advance, then sensor 101 is mounted to housing 2 via tubes 21.

The inner diameter of first cylindrical tube 18 is determined such that refrigerating machine oil 50 can flow smoothly regardless of a pressure, a temperature, or an amount of refrigerant melted, and also oil surface 9 in housing 2 becomes always flush with oil surface 9 in sensor 101. Other structures remain unchanged from those in the first embodiment.

The second embodiment can obtain an advantage similar to that of the first embodiment. On top of that, the second embodiment gains the following advantage: Use of smaller diameters to second tube 202 and third tube 203 reduces the heat quantity in brazing, so that adverse influence due to thermal strain can be suppressed. Oil surface sensor 101 can be mounted to housing 2 after the compressor except sensor 101 is assembled, so that the construction of the compressor can be simplified and also the manufacturing steps can be simplified, and sensor 101 can be replaced or repaired with ease.

Exemplary Embodiment 3

The third exemplary embodiment of the present invention proposes that first detector 15 and second detector 16 described in the first and the second embodiments be mounted at a place corresponding to the middle between the upper limit and the lower limit of oil surface 9 of refrigerating machine oil 50 in housing 2, and at a place lower than the middle.

This structure allows second detector 16 to detect the lowering of oil surface 9 before oil surface 9 lowers to the lower limit, thereby starting an oil surface rebounding action for raising the oil surface. Failure of lubrication due to the lowering of oil surface 9 below the lower limit can be thus positively prevented. As a result, the compressor improves its reliability. First detector 15 placed at the middle detects oil surface 9 raised by the action, so that the rebounding action is halted when oil surface 9 reaches the middle, and stable oil surface 9 can be always maintained. As a result, it can be avoided that too much amount of refrigerating machine oil 50 is poured into compressor 1, so that adverse influence to the performance of compressor 1 is suppressed.

Exemplary Embodiment 4

The fourth exemplary embodiment of the present invention proposes that first detector 15 and second detector 16 described in the first and the second embodiments use thermistors, which detect a difference in temperature between gas refrigerant 70 and refrigerating machine oil 50. The temperature difference tells a position of oil surface 9.

Use of thermistors in detectors 15 and 16 improves detection sensitivity. In other words, the thermistors employed in the detectors generate heat by applying a voltage thereto. The temperatures of the thermistors heated differ from each other due to the difference in heat dissipation amount of the fluid around although their ambient temperatures are the same. Compressor 1 contains gas refrigerant 70 and refrigerating machine oil 50 therein, and if both of them have the same temperature, gas refrigerant 70 dissipates less heat, so that the thermistor on gas refrigerant 70 side detects a higher temperature. As discussed above, the two temperatures detected by the two thermistors show a difference because one thermistor is in gas refrigerant 70 and another is in refrigerating machine oil 50. This structure thus allows improving the sensitivity of detecting the oil surface not only in normal operation but also in a transition period where a temperature of gas refrigerant sucked into the compressor drastically changes.

What is claimed is:

1. A hermetic compressor comprising:

a housing accommodating a motor and a compressing mechanism driven by the motor;

refrigerating machine oil pooled in the housing; and an oil surface sensor disposed to a side wall of the housing, wherein the oil surface sensor includes:

a detector for detecting a position of oil surface of the machine oil;

a hermetic terminal integrally formed with the detector;

a first cylindrical tube having a first end and a second end, the first cylindrical tube having a smaller diameter than that of the housing;

second and third cylindrical tubes, each having a smaller diameter than the first cylindrical tube; and a lid at the second end of the first cylindrical tube, the lid including at least two openings from which the second and third cylindrical tubes extend to the side wall of the housing, wherein the hermetic terminal is disposed at a first end of the first cylindrical tube, and the detector is disposed inside of the first cylindrical tube and outside of the housing.

2. The hermetic compressor of claim 1, wherein the detectors are mounted at a place in a middle of an upper limit and a lower limit of the oil surface of the machine oil in the housing and at a place lower than the middle.

3. The hermetic compressor of claim 1, wherein the detector employs a thermistor, which detects a temperature difference between gas refrigerant and the refrigerating machine oil both in the housing, for detecting a position of the oil surface.

4. The hermetic compressor of claim 2, wherein the detector employs a thermistor, which detects a temperature difference between gas refrigerant and the refrigerating machine oil both in the housing, for detecting a position of the oil surface.

5. The hermetic compressor of claim 1, wherein:

the detector includes first and second thermistors disposed inside the first cylindrical tube; and the hermetic terminal includes first, second and third electrodes, the first and second electrodes are configured to electrically connect the first thermistor external to the housing and the second and third electrodes are configured to electrically connect the second thermistor external to the housing.

6. The hermetic compressor of claim 1, wherein the detector includes first and second thermistors disposed inside of the first cylinder tube; and the hermetic terminal includes first, second and third electrodes, the first thermistor is disposed inside of the first cylindrical tube at a first level relative to the pooled refrigerating machine oil which is above that of the first, second and third electrodes and the second thermistor is disposed inside of the first cylindrical tube at a second level relative to the pooled refrigerating machine oil which is below that of the first, second and third electrodes.

7. The hermetic compressor of claim 1, wherein the first cylindrical tube is connected to the housing via first and second input ports to enable the pooled refrigerating machine oil to flow into the first cylindrical tube.

* * * * *